US008220766B2

(12) United States Patent
Fuoss

(10) Patent No.: US 8,220,766 B2
(45) Date of Patent: Jul. 17, 2012

(54) TABLE GUARD ASSEMBLY

(76) Inventor: Paul Henry Fuoss, Oak Park, IL (US)

( * ) Notice: Subject to any disclaimer, the term of this patent is extended or adjusted under 35 U.S.C. 154(b) by 545 days.

(21) Appl. No.: 12/154,172

(22) Filed: May 21, 2008

(65) Prior Publication Data

US 2009/0289165 A1 Nov. 26, 2009

(51) Int. Cl.

| | |
|---|---|
| ***A47B 95/00*** | (2006.01) |
| ***A47B 17/00*** | (2006.01) |
| ***A47F 5/00*** | (2006.01) |
| ***F16M 13/00*** | (2006.01) |

(52) U.S. Cl. ..... 248/345.1; 108/27; 211/183; 248/615

(58) Field of Classification Search ..... 248/345.1, 248/615; 108/27; 211/183

See application file for complete search history.

(56) References Cited

U.S. PATENT DOCUMENTS

| | | | | | |
|---|---|---|---|---|---|
| 1,915,774 | A | * | 6/1933 | Busch | 5/426 |
| 2,092,441 | A | * | 9/1937 | Ciprus | 108/66 |
| 2,168,919 | A | * | 8/1939 | Sullivan | 297/464 |
| 2,722,693 | A | * | 11/1955 | Wolf | 5/426 |
| 2,751,608 | A | * | 6/1956 | Lucas | 5/426 |
| 2,769,984 | A | * | 11/1956 | Skirvin | 4/551 |
| 2,869,949 | A | * | 1/1959 | Kennedy et al. | 108/27 |
| 2,917,262 | A | * | 12/1959 | Huff | 248/172 |
| 2,957,587 | A | * | 10/1960 | Tobin | 108/27 |
| 3,133,760 | A | * | 5/1964 | Robinson | 297/174 CS |
| 3,215,381 | A | * | 11/1965 | Ching | 248/167 |
| 4,084,277 | A | * | 4/1978 | Conrad et al. | 5/430 |
| 4,117,782 | A | | 10/1978 | Cahill | |
| 4,153,230 | A | * | 5/1979 | Giacin | 248/345.1 |
| 4,217,670 | A | | 8/1980 | Sciongay, Sr. et al. | |
| 4,298,126 | A | * | 11/1981 | Filipowicz | 211/50 |
| 4,314,543 | A | * | 2/1982 | Bullington et al. | 126/201 |
| 4,503,780 | A | * | 3/1985 | Apissomian | 108/27 |
| 4,530,539 | A | * | 7/1985 | Gaber et al. | 297/174 CS |
| 4,582,739 | A | * | 4/1986 | Givens | 428/83 |
| 4,629,247 | A | * | 12/1986 | Wu | 297/174 CS |
| 4,708,183 | A | * | 11/1987 | Figueroa | 108/90 |
| 4,740,034 | A | * | 4/1988 | Snyder et al. | 297/452.59 |
| 4,810,550 | A | | 3/1989 | Gasser | |
| 4,823,709 | A | * | 4/1989 | Tesney | 108/157.15 |
| 4,920,896 | A | * | 5/1990 | Holden | 108/90 |
| 4,941,413 | A | * | 7/1990 | Vanderminden | 108/157.15 |
| 5,022,622 | A | * | 6/1991 | Schaevitz | 248/231.71 |
| 5,036,777 | A | * | 8/1991 | Barton | 108/90 |
| 5,480,211 | A | * | 1/1996 | Douglas et al. | 297/174 CS |
| 5,639,072 | A | | 6/1997 | McCall | |
| 5,809,901 | A | * | 9/1998 | Gutzmer | 108/27 |
| 6,044,774 | A | | 4/2000 | Gelbart | |
| 6,116,162 | A | | 9/2000 | Santa Cruz et al. | |
| 6,273,503 | B1 | * | 8/2001 | Cheng | 297/174 CS |
| 6,325,342 | B1 | * | 12/2001 | Dignat | 248/118 |
| 6,338,302 | B1 | * | 1/2002 | Montagner | 108/90 |
| 6,378,831 | B1 | | 4/2002 | Copeland, Jr. | |
| 6,412,739 | B1 | * | 7/2002 | Smith | 248/217.2 |

(Continued)

*Primary Examiner* — Terrell McKinnon
*Assistant Examiner* — Chiedu Chibogu
(74) *Attorney, Agent, or Firm* — Brinks Hofer Gilson & Lione

(57) ABSTRACT

A guard for with a furniture element is provided. The furniture element has a perimeter with an edge portion and a bottom surface. The guard includes a movable rail, a support member and a resilient connection member. The movable rail extends along a portion of the furniture element and is spaced apart therefrom. The support member is connected to the rail and the bottom surface of the furniture element. The resilient connection member connects the support to the furniture element.

18 Claims, 4 Drawing Sheets

U.S. PATENT DOCUMENTS 6,659,546 B2 * 12/2003 Schmeing et al. ..... 297/157.1
6,687,929 B2 * 2/2004 DeFranks et al. ..... 5/254
6,708,941 B1 3/2004 Bowen et al.
7,216,765 B2 * 5/2007 Markert et al. ..... 206/586
7,334,531 B2 * 2/2008 Rivera et al. ..... 108/157.15
7,523,515 B2 * 4/2009 Allen et al. ..... 5/738
7,624,459 B2 * 12/2009 Nygren et al. ..... 5/430
7,823,520 B2 * 11/2010 Mayben ..... 108/129
2004/0187209 A1 * 9/2004 Flannery et al. ..... 5/425
2005/0155526 A1 * 7/2005 Blanchette ..... 108/27
2006/0172114 A1 8/2006 Hancock
2006/0236897 A1 10/2006 Pofeldt
2007/0006781 A1 * 1/2007 Xiang ..... 108/27
2008/0173211 A1 * 7/2008 Kennedy ..... 105/199.3
2009/0189045 A1 * 7/2009 Peckovich ..... 248/345.1

* cited by examiner

TABLE GUARD ASSEMBLY

FIELD OF THE INVENTION

The present invention relates generally to the field of safety or guard assemblies for use with the edge of a table or other surface. More specifically, the present invention relates to a furniture or table guard useful to protect a toddler from injuring himself or herself on the edge thereof and also to provide a flexible support for use by the toddler when learning to walk.

BACKGROUND OF THE INVENTION

It is well known that it is important to shield the sharp edges of tables such as coffee tables so that a toddler or child does not hurt himself if he falls. Typical devices directed to this field in the past use foam or other soft materials that are either glued or elastically attached to the perimeter of the table. For example, U.S. Pat. No. 4,153,230 entitled "Baby Bumpers" is directed to a stretchable rubber bead that snap-fits around the periphery of a piece of furniture such as a table. While this device and similar devices may fulfill particular objectives and requirements, these devices have limitations because toddlers often want to pull themselves up to a standing position and find the sides tables convenient for this purpose. However, when grabbing the edge material or bumper, toddlers may pull it off as they hold the edge material or bumper. Because this edge material or bumper may be pulled off, there is the possibility that a toddler may injure himself as he falls back to the ground. In addition, when toddlers are trying to stand near a table, they may grab at items left on the table in an attempt to pull themselves up. Again, this leads to the possibility that a toddler may hurt himself by pulling an item off the table and then falling to the ground.

Accordingly, there exists a need for a table guard that provides for a more resilient protection around the surface of a furniture element. In addition, there is the need for a more resilient table guard assembly that provides assistance to a toddler as he learns to walk.

SUMMARY OF THE INVENTION

The present invention is directed to a furniture or table guard assembly with improved protection and greater versatility than baby bumpers of previous constructions.

According to a first aspect of the invention, a guard for use with a furniture element is provided. The furniture element has a perimeter with an edge portion and a bottom surface. The guard includes a movable rail, a support member and a resilient connection member. The movable rail extends along a perimeter of the furniture element and is spaced apart therefrom. The support member is connected to the rail and the bottom surface of the furniture element. The resilient connection member connects the support to the furniture element.

According to another aspect of the invention, a movable guard for use with a table is provided. The table includes a perimeter with an edge portion and a bottom surface. A movable rail substantially surrounds a perimeter of the table. The rail is spaced apart from the edge of the table. A connector interconnects the rail to the table. The connector provides for a vertical movement of the rail and a horizontal movement of the rail. The connector includes a support member that extends from the rail to a bottom surface of the table, and a spring interconnects the support member and the table.

According to a further aspect of the invention, a table guard for use with a table is provided. The table has a perimeter with an edge portion and a bottom surface. The guard includes a curved movable rail extending around the perimeter of the furniture element. A connector interconnects the rail to the table. The connector provides for a vertical movement of the rail and a horizontal movement of the rail. The connector includes a support member that extends from the rail to a bottom surface of the table and a spring that interconnects a central portion of the support member and the table.

The present invention, together with its attendant objects and advantages, will be best understood with reference to the detailed description and attached drawings.

DETAILED DESCRIPTION OF THE DRAWINGS AND THE PRESENTLY PREFERRED EMBODIMENTS

The present invention is directed to a furniture guard assembly that provides improved protection for a toddler with greater versatility than baby bumpers of previous constructions. In addition to providing protection against injury from the edge of a furniture element, the present invention provides a flexible rail that a toddler can hold as he walks along the edge of the furniture element. Further, the movable and flexible nature of the rail provides an assembly that makes it easier for the toddler to hold onto the rail.

As used herein, the term "furniture element" or "table" should be interpreted broadly to include known furniture items such as known tables of various shapes, sizes and constructions and known cabinets and other known furniture elements. As also used herein, the term "rail" should be interpreted broadly to include round shapes, rectangular shapes or other known shapes. As further used herein, the term "toddler" is intended to be interpreted broadly to include infants and children.

Figure 1:
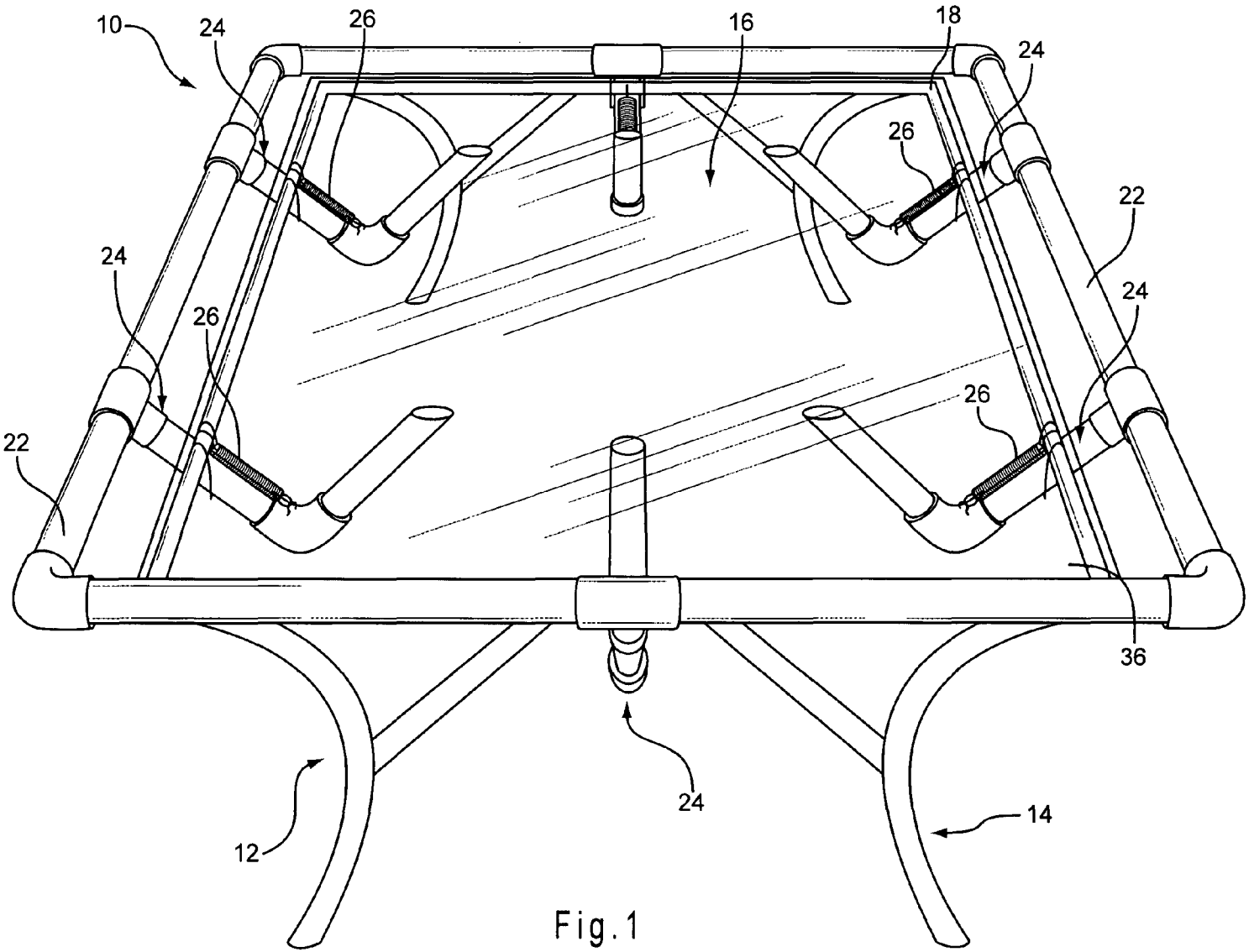
FIG. 1 is a perspective view of a table guard assembly according to an embodiment of the present invention shown attached to a table.
Figure 2:
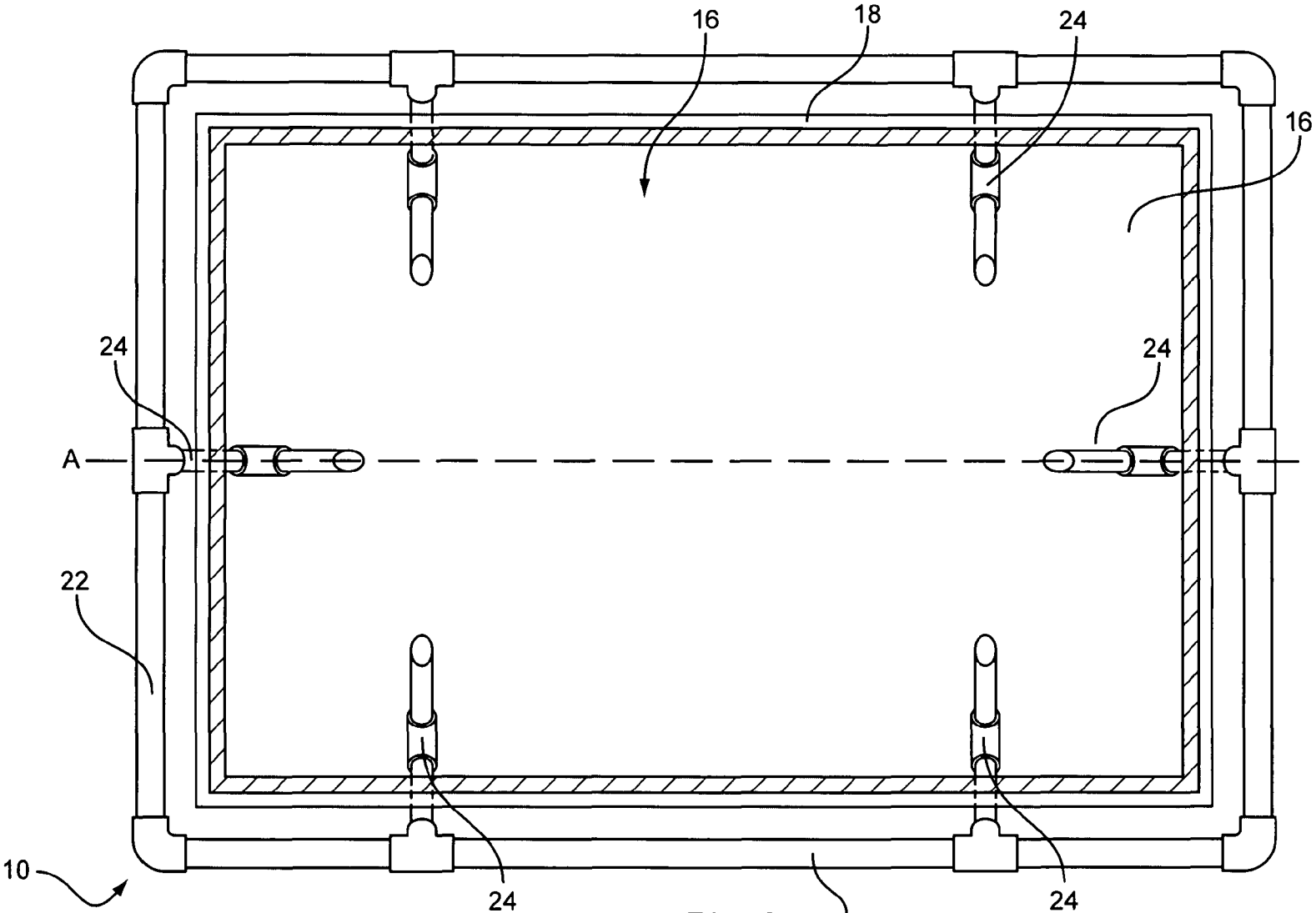
FIG. 2 is a top view of the table guard assembly of FIG. 1.

FIG. 1 is a perspective view of a first embodiment of the table guard assembly 10 according to the present invention. The table guard assembly 10 is shown attached to the table 12. The table 12 is just one representative example of the known tables or surfaces that may implement the table guard assembly 10 of the present invention. The table 12 includes legs 14 and a table top 16 having an edge 18. In the present embodiment, the table top 16 is formed from glass although it should be recognized that other materials may be implemented with the present invention.

The table guard assembly 10 includes the rail 22, support members 24 and resilient connection elements or springs 26. The rail 22 and support members 24 are shown formed from a tubular material such as PVC pipe. However, it should be recognized that other materials having other shapes and sizes may also be implemented with the present invention. In addition, the rail 22 is shown spaced apart from the edge 18 of the table top 6 in the present embodiment. This feature is useful because it allows for a toddler to grasp the rail 22 while also providing enough recoil room for fall protection. In addition, the rail 22 is spaced above the table top 16. This feature is useful because it will help prevent a toddler from pulling an object off the table top 16. In an alternate embodiment, it should be recognized that the rail 22 could be spaced closer to the edge 18.

Figure 4:
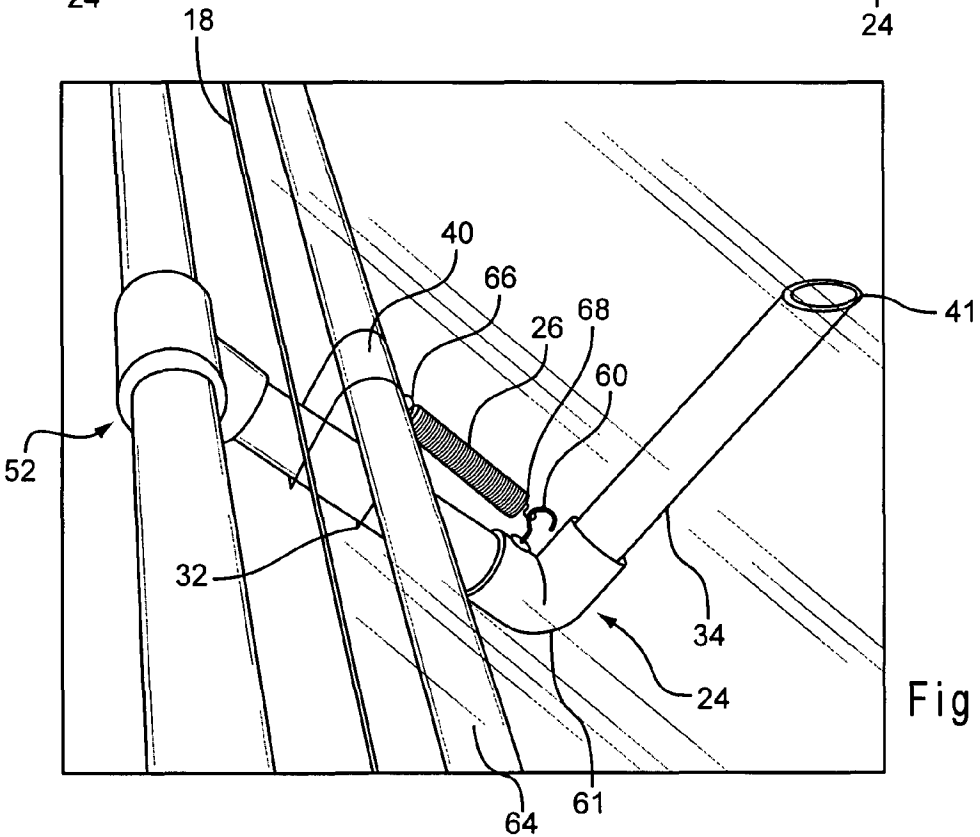
FIG. 4 is an enlarged view of one of the support members of FIG. 3.

As best seen in FIG. 4, the support members 24 include a first portion 32 that extends downward and inward and a second portion 34 that extends inward and upward to meet the bottom surface 36 of the table top 16. The second portion 34 of the support member 24 includes an end 41 that slidably engages the bottom surface 36 of the table top 16. The support members 24 have a generally V-shaped construction in the present embodiment. However, it should be recognized that the support members 24 may be formed from other shapes such as the rectangular embodiment shown in FIGS. 5-6.

The spring 26 provides for a resilient connection between the support members 24 and the edge 18 of the table top 16. The spring 26 is secured using a clip 40. While a spring 26 is illustrated, other known means such as other types of springs may be implemented to provide for a resilient connection between the support member 24 and the table top 16. For example, an elastomer spring may be preferred because it does not have any sharp edge of pinch points. In addition, the exact location of the connection spring 26 between the support member 24 and table top 16 may be varied as shown, for example, in the embodiment of FIGS. 5-6.

The table guard assembly 10 provides a rail 22 having a capability for a horizontal movement, a vertical movement or a combination thereof. The rail 22 is capable of a constrained movement in a plurality of directions in order to provide support for a toddler learning to walk. The rail 22 is capable of moving a limited distance down and then in to protect a toddler against falls. In other words, the present embodiment is capable of greater movement in the horizontal direction than in the vertical so that a toddler may use it as a rail 22.

The table guard assembly 10 provides a device that helps protect a toddler from injury should he fall adjacent the rail 22. In particular, the movement of the rail 22 provides a surface that will give if a toddler falls into the rail 22. The movement of the rail 22 helps lessen any potential injury as a result striking the rail. The rail 22 actually describes a somewhat elliptical path with a vertical blow so that it moves down and in away from the impact in order to protect the toddler.

Figure 3:
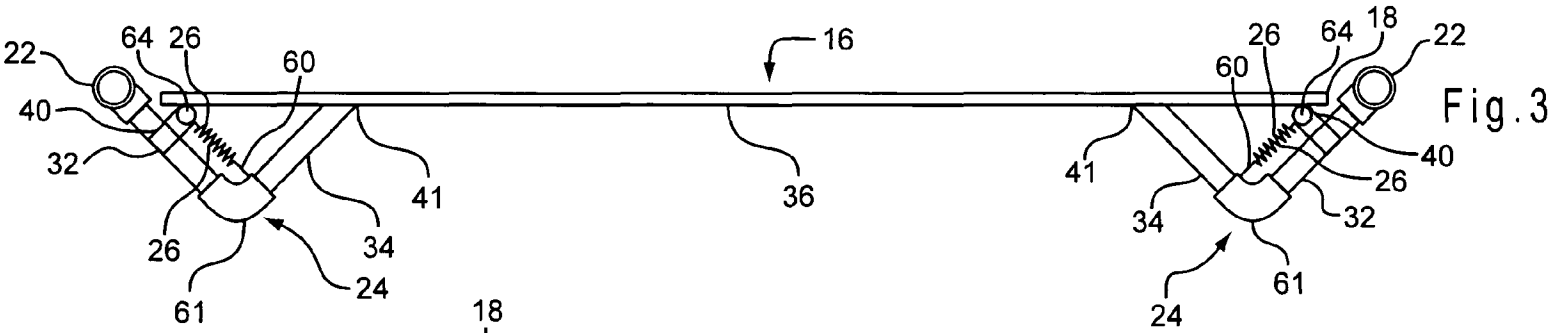
FIG. 3 is a side view of the table guard assembly of FIGS. 1-2.

FIGS. 3-4 illustrate the support member 24 in greater detail. In particular, a hook 60 is shown on a central portion 61 of the support member 24. The clip 40 extends over the lower support rail 64. The clip 40 provides an opening to receive a first end 66 of the spring 26 with the second end of the spring 68 shown attached to the hook 60.

Figure 5:
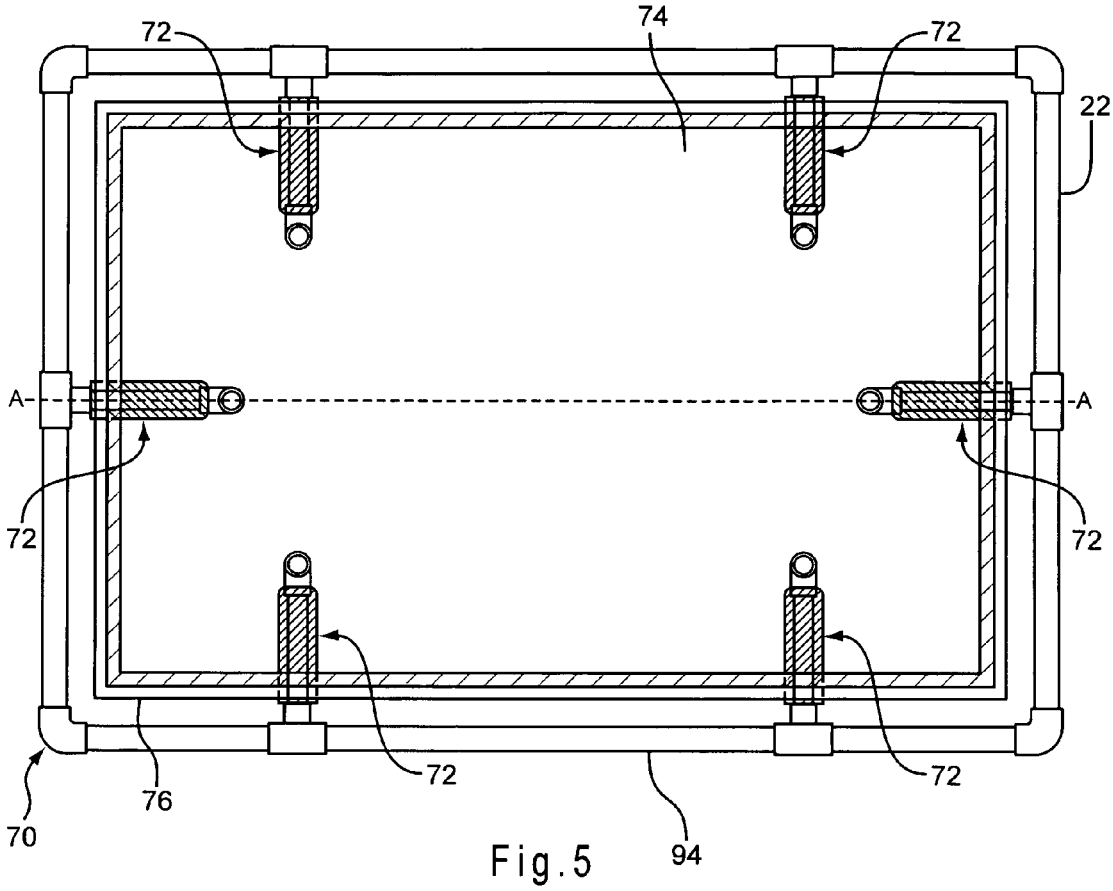
FIG. 5 is a top view of a table guard assembly according to a second embodiment of the present invention.
Figure 6:
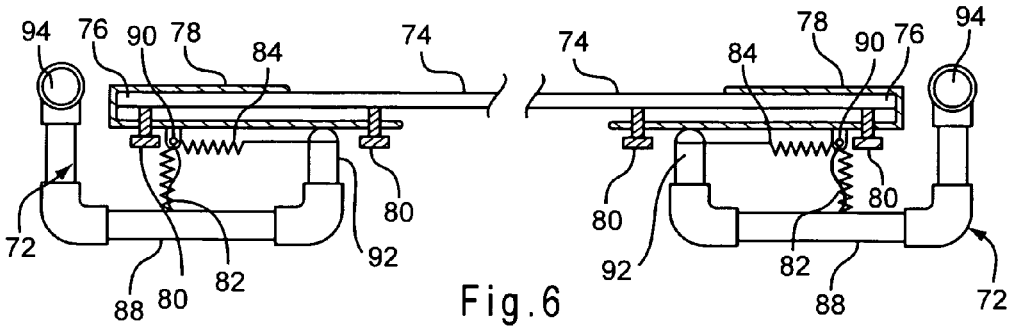
FIG. 6 is a cross-section of the table guard assembly as shown in FIG. 5.

FIGS. 5-6 illustrate a second embodiment of the table guard assembly 70 that operates in the same general manner as in FIGS. 1-4, except for a variance in the specific construction of the support members 72 and the resilient connection to the table top 74. The present embodiment provides for a more universal connection to tables of varying construction.

The support members 72 have a generally rectangular construction and are connected to a bracket 78. The bracket 78 is connected to the edge 76 of the table top 74. In particular, the bracket 78 has a generally C-shaped construction that fits around the edge 76 of the table top 74. Screws 80 secure the bracket 78 to the table top 74. In the present embodiment, springs 82, 84 interconnect the support members 72 to the bracket 78. More specifically, the spring 82 interconnects a central portion 88 of the support member 72 to a tab 90 that is connected to the bracket 78. The spring 84 interconnects the end 92 of the support member 72 to the tab 90. This embodiment provides for a similar type of movement by the rail 94 as demonstrated by previous embodiments.

The embodiments described above and shown herein are illustrative and not restrictive. The scope of the invention is indicated by the claims rather than by the foregoing description and attached drawings. The invention may be embodied in other specific forms without departing from the spirit of the invention. For example, the present invention may be used on furniture elements other than tables, and the exact size and construction of the elements of the present invention may be varied in a manner other than as specifically described or illustrated in the figures. Accordingly, these and any other changes which fall within the scope of the claims are intended to be embraced herein.

I claim:

1. A guard assembly for use with a furniture element having a perimeter with an edge portion and a bottom surface, the guard assembly comprising:

a) a movable rail entirely surrounding the perimeter of the furniture element and spaced entirely apart therefrom;

b) a support member including a first portion connected to the rail and extending downward from the rail, a second portion extending toward and directly contacting the bottom surface of the furniture element, and a central portion connecting the first portion and the second portion; and c) a resilient connection member in contact with and connected to the bottom surface of the furniture element at a first end of the resilient connection member, and connected to the central portion of the support member at a second end of the resilient connection member;

wherein the rail is moveable in a vertical direction and a horizontal direction relative to the perimeter of the furniture element via the support member and the resilient connection member.

2. The guard assembly of claim 1 wherein the rail has a generally curved surface.

3. The guard assembly of claim 1 wherein the second portion of the support member includes an end portion that directly contacts the bottom surface of the furniture element.

4. The guard assembly of claim 3 wherein the support member forms a V-shape.

5. The guard assembly of claim 1 wherein the resilient connection member is a spring positioned below the bottom surface of the furniture element.

6. A movable guard assembly for use with a table having a perimeter with an edge portion and a bottom surface, comprising:

a) a movable rail substantially surrounding the perimeter of the table, the rail spaced entirely apart from the edge of the table; and b) a connector connecting the rail to the table, the connector configured to facilitate a constrained vertical movement for the rail and a constrained horizontal movement for the rail such that when a force is applied to the rail, the rail moves a limited distance providing a recoil for fall protection, and then resists further movement providing support for use as a handrail, the connector including a support member that extends from the rail to the bottom surface of the table and a spring positioned under the bottom surface of the table and interconnecting the support member and the table.

7. The movable guard assembly of claim 6 wherein the support member forms a V-shape.

8. The movable guard assembly of claim 6 wherein the support member forms a U-shape.

9. The movable guard assembly of claim 6 wherein the spring is a elastomer spring.

10. The movable guard assembly of claim 9 wherein the spring is connected to a generally central portion of the support member.

11. The movable guard assembly of claim 10 wherein the spring is further connected to the edge portion of the table.

12. The movable guard assembly of claim 10 wherein the spring is further connected to the bottom surface of the table.

13. The movable guard assembly of claim 12 wherein the spring is connected to the bottom surface of the table via a bracket.

14. A table guard for use with a table having a perimeter, an edge portion and a bottom surface, the table guard comprising:

a) a curved movable rail extending around the perimeter of the table;

b) a connector connecting the rail to the table, the connector configured to facilitate a vertical movement for the rail and a horizontal movement for the rail, the connector including a support member that extends from the rail to the bottom surface of the table, the support member being V-shaped and including a first portion attached to the rail and extending downward from the rail, a second portion extending toward and contacting the bottom surface of the table, and a central portion connecting the first portion and the second portion, the connector further including a spring attached to and interconnecting the central portion of the support member and the table.

15. The table guard of claim 14 wherein the spring is further connected to the edge of the table.

16. The table guard of claim 14 wherein the spring is further connected to the bottom surface of the table.

17. The table guard of claim 14, wherein the first portion or the second portion of the support member has a rounded cross-section.

18. The table guard of claim 14, wherein the first portion and the second portion are straight.

* * * * *